US010115499B2

(12) United States Patent
Armbrecht et al.

(10) Patent No.: US 10,115,499 B2
(45) Date of Patent: Oct. 30, 2018

(54) CABLE ARRANGEMENT

(71) Applicant: ROSENBERGER HOCHFREQUENZTECHNIK GMBH & CO. KG, Fridolfing (DE)

(72) Inventors: Gunnar Armbrecht, Mühldorf am Inn (DE); Thomas Müller, Berchtesgaden (DE); Stephan Kunz, Chieming (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/109,302

(22) PCT Filed: Dec. 16, 2014

(86) PCT No.: PCT/EP2014/003370

§ 371 (c)(1),
(2) Date: Jun. 30, 2016

(87) PCT Pub. No.: WO2015/110134

PCT Pub. Date: Jul. 30, 2015

(65) Prior Publication Data

US 2016/0336095 A1 Nov. 17, 2016

(30) Foreign Application Priority Data

Jan. 23, 2014 (DE) ..... 10 2014 000 897

(51) Int. Cl.
*H01B 7/00* (2006.01)
*H01B 11/04* (2006.01)
(Continued)

(52) U.S. Cl.
CPC ..... *H01B 11/04* (2013.01); *H01B 7/36* (2013.01); *H01B 11/002* (2013.01); *H01B 11/005* (2013.01); *H01B 13/0036* (2013.01)

(58) Field of Classification Search
CPC ..... H01B 7/02
(Continued)

(56) References Cited

U.S. PATENT DOCUMENTS 2,869,316 A 1/1959 Lilly
4,263,471 A * 4/1981 Bauguion ..... H01B 11/04 174/34
(Continued)

FOREIGN PATENT DOCUMENTS

DE 102012204554 A1 9/2013
EP 1174886 A * 6/2001 ..... H01B 11/02
(Continued)

*Primary Examiner* — William H Mayo, III
(74) *Attorney, Agent, or Firm* — DeLio, Peterson & Curcio, LLC; Robert Curcio

(57) ABSTRACT

A cable arrangement of at least two cables which extend adjacently in a substantially parallel manner, a first cable and a second cable of which each having at least one stranding group which has two or more conductors that are twisted together. The length of lay of each of the stranding groups varies in the longitudinal direction of the individual cables. In addition, the length of lay of a stranding group winding of the stranding group of the first cable is smaller than the length of lay of a most directly adjacent stranding group winding of the stranding group of the second cable.

17 Claims, 1 Drawing Sheet

(51) Int. Cl.
*H01B 7/36* (2006.01)
*H01B 11/00* (2006.01)
*H01B 13/00* (2006.01)

(58) Field of Classification Search
USPC ..... 174/28, 29, 36, 110 R, 113 R
See application file for complete search history.

(56) References Cited

U.S. PATENT DOCUMENTS 4,408,443 A * 10/1983 Brown ..... C07H 15/203 174/34
6,323,427 B1 * 11/2001 Rutledge ..... H01B 11/02 174/113 R
7,115,815 B2 * 10/2006 Kenny ..... H01B 11/06 174/113 R
7,375,284 B2 * 5/2008 Stutzman ..... H01B 11/06 174/110 R
7,497,070 B2 * 3/2009 Nevett ..... H01B 11/02 57/59
7,897,875 B2 * 3/2011 Gareis ..... H01B 11/06 174/113 C
2005/0045367 A1 * 3/2005 Somers ..... H01B 11/04 174/113 R
2006/0162949 A1 * 7/2006 Bolouri-Saransar ... H01B 11/04 174/113 R
2008/0142246 A1 6/2008 Bolouri-Saransar
2012/0186846 A1 7/2012 Haehner et al.
2012/0227998 A1 * 9/2012 Lindstrom ..... H01B 11/1025 174/103

FOREIGN PATENT DOCUMENTS

EP 1688968 A * 8/2006 ..... H01B 13/04
EP 2131370 A1 2/2008
GB 1037855 * 8/1966 ..... H01B 11/02
GB 1373835 * 11/1974 ..... H04L 7/04
JP S262-202417 A 2/1989
JP 2003077345 A 3/2003
JP 2008524810 A 7/2008
WO 2006066232 A1 6/2006
WO WO 2006/066232 A * 6/2006 ..... H01B 11/02

* cited by examiner

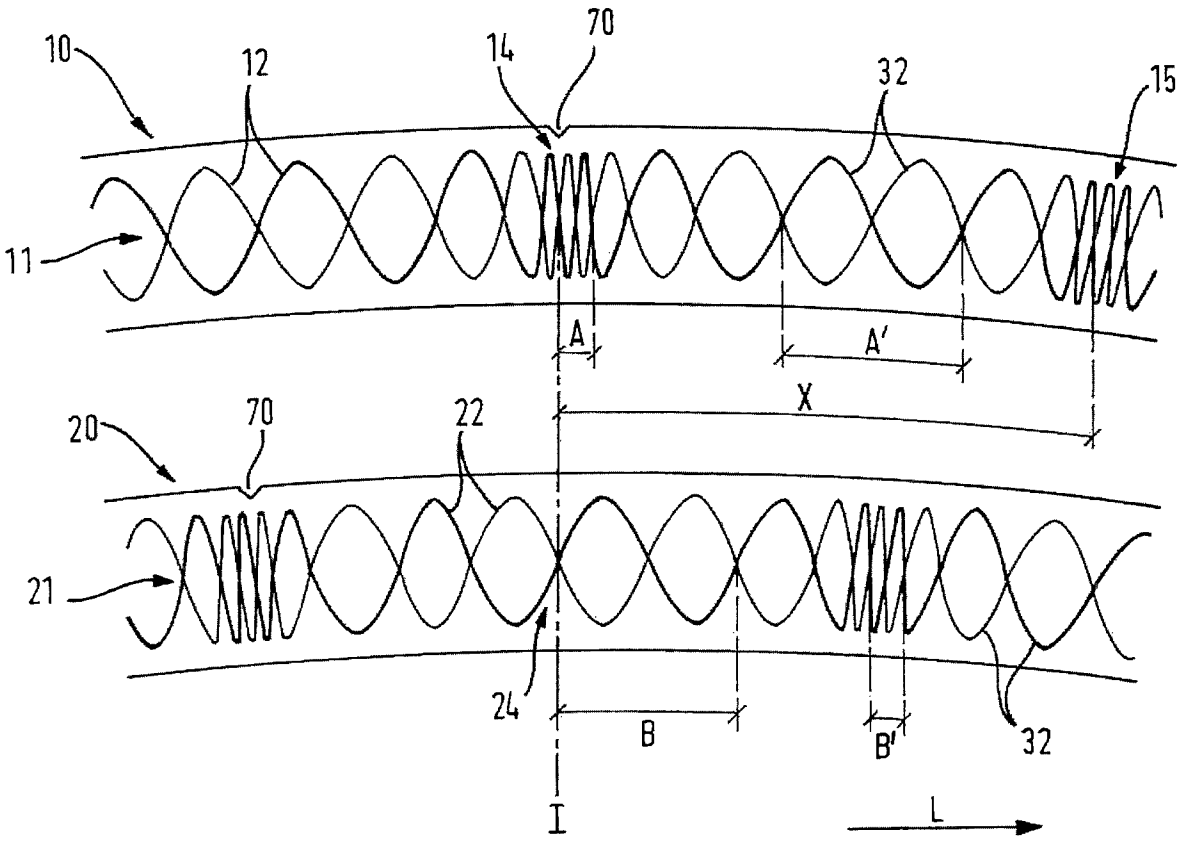
15
32
70
14
12
10
11
A'
X
A
B
B'
L
I
24
22
70
20
21
32

CABLE ARRANGEMENT

BACKGROUND OF THE INVENTION

1. Field of the Invention

The invention relates to an arrangement of at least two cables which extend adjacently in a substantially parallel manner, a first cable and a second cable of which each having at least one stranding group which has two or more conductors that are twisted together.

2. Description of Related Art

A twisting or stranding is generally understood to mean the twisting around each other in a helical manner of several wires or conductors of a cable. For example, a known twisted-pair cable has at least one stranding group which comprises two conductors which are twisted around one another. The individual conductors thereby change places in the longitudinal direction of the cable. In addition, twisted or stranded wire pairs offer better protection against external alternating electromagnetic fields and electrostatic interference.

A crosstalk between several conductor pairs running adjacent to one another in a cable can also be effectively reduced through stranding. In addition, differing lay lengths and/or directions of rotation of the individual stranding groups of a cable can be chosen. An external signal from a first conductor pair can be coupled into an adjacent second conductor pair inductively or capacitively.

Such undesired crosstalk between the cables (alien crosstalk) can also occur if several cables which each have at least one conductor pair for the transmission of differential signals are laid adjacent to one another. In order to reduce this crosstalk, the individual cables are regularly provided with a shielding. Alternatively, coaxial cables are used.

In other known solutions, the individual cables laid adjacent to one another have a particularly thick sheath or are laid at a predetermined minimum distance from one another.

The document US 2012/0186846 describes arranging several stranding groups in a cable, whereby the stranding groups can in turn be twisted together. The lay lengths of the individual strandings can vary. However, the manufacture of such a cable is particularly complex. Also, alien crosstalk can occur between several such cables which are laid adjacent to one another.

The document EP 2131 370 B1 also describes stranding two stranding groups together with one another, whereby the lay length of the group stranding varies sinusoidally. This cable too is complex to manufacture. Also, alien crosstalk can occur between several such cables which are laid adjacent to one another.

The lay length is understood to mean the pitch or turn distance of the helix traced by the stranding group. In other words, the lay length is the distance over which one of the stranded wires of a stranding group twists during a complete rotation in the longitudinal direction of the cable (z-direction).

SUMMARY OF THE INVENTION

In view of the problems described, it is the object of the present invention to provide an arrangement of several cables running adjacent to one another which are each suitable for the transmission of differential signals, wherein the arrangement is simple to manufacture, and wherein a crosstalk between the conductor pairs of the individual cables is at the same time reliably prevented.

A shielding of the individual cables should thereby preferably be omitted, since on the one hand this is expensive and on the other hand this can have a negative effect on the weight and flexibility of the cable.

This problem is solved according to the invention through a cable arrangement according to the claims. Advantageous further developments of the invention are described in various dependent claims.

The above and other objects, which will be apparent to those skilled in the art, are achieved in the present invention which is directed to an arrangement of at least two cables, comprising a first cable and a second cable which extend adjacently in a substantially parallel manner, and of which each having at least one stranding group which has two conductors that are twisted together, wherein the lay length (A, A', B, B') of each of the stranding groups varies in the longitudinal direction of the cables, and the lay length (A) of at least one stranding group winding of the stranding group of the first cable differs from the lay length (B) of an adjacent stranding group winding of the stranding group of the second cable by more than 10%, the lay length of the stranding groups varying between a minimum lay length (A) and a maximum lay length (A'), wherein a distance between two adjacent stranding sections of a stranding group with a minimum lay length (A) defines a stranding length (X), wherein the stranding length (X) of a stranding group varies periodically in the longitudinal direction of the cable (L).

The lay length (A) of at least one stranding group winding of the stranding group of the first cable differs from the lay length (B) of an adjacent stranding group winding of the stranding group of the second cable by more than 20% or by more than 50%.

The stranding groups each consist of a twisted conductor pair. The cables are in each case twisted-pair cables. The stranding groups may consist of four conductors twisted together. The cables are in each case may be star quad cables with quad stranding. Each stranding group includes at least one conductor pair for transmission of a differential signal. Each cable may have exactly one stranding group.

The lay length of the stranding groups in each case varies periodically and/or in a wave-formed manner, such as sinusoidally.

The arrangement may have a minimum lay length greater than 5 mm and less than 20 mm, or greater than 10 mm and less than 15 mm, while the maximum lay length may be greater than 15 mm and less than 50 mm, or greater than 22 mm and less than 28 mm.

The stranding length (X) is preferably greater than 0.5 m and less than 10 m, and more preferably greater than 2 m and less than 5 m.

The stranding length (X) of a stranding group varies sinusoidally in the longitudinal direction of the cable (L).

The stranding length (X) of a stranding group may vary statistically in the longitudinal direction of the cable (L) between a maximum and a minimum stranding length.

The at least two cables may be separate, individual cables, arranged at a distance from one another.

Each cable carries on its exterior at least one marking which states a lay length, a lay length pattern and/or a position of a maximum or minimum lay length in the interior of the cable, wherein the marking of the first cable is preferably offset from the marking of the second cable in the longitudinal direction of the cable (L).

At least one cable carries on its exterior markings at intervals corresponding to the respective stranding length (X).

In a second aspect, the present invention is directed to a method for manufacturing a cable arrangement comprising: providing a raw cable with at least one stranding group with two or more twisted conductors; varying the lay length (A, A') of the stranding group in the longitudinal direction of the cable between a minimum lay length (A) and a maximum lay length (N); varying a distance between two adjacent stranding sections of the at least one stranding group with a minimum lay length (A) defining a stranding length (X); wherein the stranding length (X) of a stranding group varies periodically in the longitudinal direction of the cable (L), cutting the raw cable so that at least one first and one second cable are produced; and arranging the two cables adjacent to one another such that the lay length of a stranding group winding of the first cable differs by more than 10% from the lay length of a stranding group winding of the second cable arranged next to it.

The method may further include the step of application of markings to an outer side of the raw cable depending on the pattern of the lay lengths in the interior of the raw cable.

During the step involving the arrangement step of the two cables, a marking of the first cable is positioned offset to a marking of the second cable.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 1 is a schematic sketch of a cable arrangement according to the invention.

DESCRIPTION OF THE PREFERRED EMBODIMENTS

In describing the preferred embodiment of the present invention, reference will be made herein to FIG. 1 of the drawings in which like numerals refer to like features of the invention.

According to the invention, the lay length of the stranding groups in the longitudinal direction of the individual cables is in each case variable. This means that the lay length within a (within each) stranding group varies in the longitudinal direction of the corresponding cable. In addition, the lay length of at least one stranding group winding of the stranding group of the first cable is less than the lay length of a most directly adjacent stranding group winding of the second cable, preferably by more than 10%, particularly preferably by more than 20%, in particular by more than 50%. An "adjacent stranding group winding" is understood to mean that winding of the stranding group of the second cable whose starting point (winding phase 0°) is intersected by the same sectional plane running perpendicular to the longitudinal axis of the cable as the starting point of the at least one stranding group winding of the first cable.

In other words, (at least) one sectional plane running perpendicular to the longitudinal direction through the two cables intersects the stranding group of the first cable in a first stranding section and intersects the stranding group of the second cable in a second stranding section. Starting out from this sectional plane, the stranding group of the first cable twists far less in the longitudinal direction over a full rotation of a conductor (or with less of a pitch) than the stranding group of the second cable.

Preferably, the above relationship between the lay lengths of adjacent stranding group windings of the first and second cable applies not only in one sectional plane, but in all sectional planes running through the two cables. In other words, only at few locations, or at no location in the cable arrangement in its longitudinal direction are two stranding sections with around the same lay length arranged directly adjacent to one another. Rather, adjacent stranding group windings of the two cables differ in their lay length over at least 50% of the length of the cable, in particular over the entire length of the cable, by more than 10%, in particular by 20%, 50% or more.

The invention is based on the knowledge that a crosstalk between two conductor pairs is particularly pronounced if their respective strandings run adjacent to one another with the same phase position and the same period length (lay length), because in this case the electromagnetic fields emanating from one conductor pair winding couple particularly readily into the adjacent conductor pair winding with the same lay length. If, on the other hand, the lay lengths of adjacent conductor pair windings of the two cables differ by at least 10%, a crosstalk between the two cables is greatly attenuated. According to the invention it is thus important also to arrange the two cables next to one another in such a way that two adjacent windings of the stranding groups of the two cables each have different lay lengths.

For this purpose, the cables can have externally visible markings or similar by means of which the lay length at a particular location in the interior of cable and/or over the course of the lay line is stated or at least made determinable. The cables of the arrangement can then be arranged adjacent to one another such that the markings are in each case positioned offset in relation to one another. This ensures that the specified relationship between the lay lengths in the interior of adjacent cables is fulfilled.

Preferably, the stranding groups consist in each case of a twisted conductor pair. The cables can in each case be twisted-pair cables, each with one or more twisted conductor pairs.

Alternatively, the stranding groups can in each case consist of four conductors twisted together. The cables can in this case be star quad cables with quad stranding.

The advantageous effects of the invention are manifested particularly clearly if each stranding group contains at least one conductor pair for transmission of a differential signal, since such conductor pairs running adjacent to one another are particularly susceptible to alien crosstalk.

A cable arrangement according to the invention is particularly simple to manufacture if each cable has exactly one stranding group.

In a preferred embodiment of the invention, the lay length of the individual stranding groups in each case varies, preferably periodically and/or in a wave-formed manner, in particular substantially sinusoidal, between a minimum lay length and a maximum lay length. Such a variation in the lay length in the longitudinal direction of the cable can be generated through a periodic and/or wave-formed adjustment of the rotational speed of the stranding machine used to manufacture the strandings of the cables.

In other words, the lay length of a stranding group describes a wave-formed, periodic and/or sinusoidal curve possessing maxima and minima, depending on the longitudinal extension of the cable.

The distance between two adjacent stranding sections of a stranding group with minimum lay length thereby defines a stranding length. In other words, a stranding length is the distance between two sectional planes running perpendicular to the longitudinal direction of the cable which in each case run through the starting point (phase 0°) of a particularly closely-wound winding, whereby between the two particularly closely-wound windings there is a particularly widely-wound winding, that is to say the standing length is the distance between two minima of the curve explained above.

The stranding length can remain constant over the entire length of the cable; alternatively, however, it can vary over the length of the cable.

Preferably, the lay length varies between a minimum lay length of more than 5 mm and less than 20 mm, preferably more than 10 mm and less than 15 mm, and a maximum lay length of more than 15 mm and less than 50 mm, preferably more than 22 mm and less than 28 mm. Such lay lengths can be manufactured using stranding machines at reasonable expense and offer good protection against influencing of the transmitted signals through external fields.

In a preferred embodiment, the stranding length is greater than 0.5 m and less than 10 m, preferably greater than 2 m and less than 5 m. The stranding length can thereby be constant in the longitudinal direction of the cable, for example if the lay length, as a function of the longitudinal extension of the cable, has an exact sinusoidal length.

However, the stranding length of the individual stranding groups can also vary in the longitudinal direction of the cable, preferably periodically, in particular substantially sinusoidal. This allows possible alien crosstalk between two adjacent cables to be suppressed particularly effectively.

Alternatively, the stranding length of a stranding group can vary statistically in the longitudinal direction of the cable between a maximum and a minimum stranding length, whereby the maximum and minimum stranding length can be specified to the stranding machine.

In a preferred embodiment, the at least two cables are separate, individual cables, in particular arranged at a distance from one another, which preferably run next to one another in the form of a bundle. The cables can be guided next to one another in guides and/or in a shared mounting. They can be arranged at a defined distance from one another. It is not necessary, but possible that the cables run next to one another over their entire length. They can also only run parallel or substantially parallel to one another in sections, if for example they are accommodated at one end in a shared cable connector, mounting or similar.

According to a further aspect, the invention relates to a method for manufacturing an arrangement of at least two cables which extend adjacently in a substantially parallel manner in which a raw cable is manufactured with at least one stranding group with two or more twisted conductors, wherein the lay length of the stranding group varies in the longitudinal direction of the cable, the raw cable is cut, so that at least one first and one second cable are produced, and the two cables are arranged adjacent to one another such that the lay length of at least one stranding group winding of the first cable differs by more than 10%, preferably by more than 20%, in particular by more than 50% from the lay length of a stranding group winding of the second cable arranged next to it.

If the raw cable is manufactured with constant stranding length over its entire length, during the step of cutting the raw cable it should be ensured that the cable lengths of the cables produced are not multiples or fractions of the stranding length. In this case, the pattern of lay lengths of consecutively cut cables differs if these are arranged adjacent to one another.

If the raw cable carries markings on its exterior which state the pattern of lay lengths and/or a maximum or minimum lay length in the interior of the cable, according to the invention the cables can be laid adjacent to one another during the arrangement step in a simple manner, for example in that the markings are arranged offset from one another by a predetermined minimum distance.

In the following description, the invention is explained with reference to the attached drawing, FIG. 1. The single FIGURE in the drawing shows: a schematic sketch of a cable arrangement according to the invention.

An arrangement, according to the invention, of two cables 10, 20 which, at least in sections, run adjacent to one another is shown. This is a schematic sketch illustrating the underlying principle. It is indicated that two stranded or twisted wires or conductors 32 run in each of the cables 10, 20. Two twisted conductors 32 in each case form a stranding group 11, 21. In other words, the wires of a stranding group are twisted around one another in a helical form. Over a full rotation, each of the stranded wires moves by a lay length in the longitudinal direction L of the cable.

The first cable 10 is a twisted-pair cable and comprises exactly one stranding group 11, which comprises two conductors 32 twisted together with one another. The two conductors 32 are each surrounded by a wire insulation made of an insulating material. The stranding group 11 is surrounded by a protective jacket in order to form the cable 10.

The second cable 20 is also a twisted-pair cable and comprises exactly one stranding group 21, which comprises two conductors 32 twisted together with one another. The two conductors 32 are each surrounded by a wire insulation made of an insulating material. The stranding group 21 is surrounded by a protective jacket in order to form the cable 20.

The lay length of the stranding group 11 of the first cable varies in the longitudinal direction L, for example sinusoidally, between a minimum lay length A and a maximum lay length A'. The minimum lay length A amounts to around 12 mm and the maximum lay length amounts to around 25 mm. The distance between two adjacent stranding sections (14, 15) with a minimum lay length A defines a stranding length X. The stranding length is constant over the entire length of the cable 10.

The lay length of the stranding group 21 of the second cable also varies sinusoidally in the longitudinal direction L between a minimum lay length B' (where B'=A) and a maximum lay length B (where B=A'). The stranding length is also constant over the entire length of the cable 20 and amounts to X.

A sectional plane I running through the two cables intersects the stranding group 11 of the first cable 10 in a stranding section 14 at which the lay length of the first stranding group 11 has a value A, and it intersects the stranding group 21 of the second cable 20 in a stranding section 24 at which the lay length of the second stranding group 21 has a value B, whereby A differs from B by more than 50%. In particular, A is less than B by more than 50%.

This relationship between the lay lengths of directly adjacent stranding group windings of the first and second cables 10, 20 applies over more than 50% of the entire length of the cables 10, 20. This effectively reduces an alien crosstalk between the cables 10, 20.

In the stranding section 14, at which the first stranding group 11 has a minimum lay length A, a for example notch-aimed marking 70 is arranged on the outside of the cable. Such markings can be applied to the cable visibly at intervals corresponding to the respective stranding length over the entire length of the cable. The cable layer then knows, when laying the cable, where in the longitudinal direction of the cable the lay length assumes a minimum value and can create an arrangement according to the invention in a simple manner.

The invention is not limited to the described exemplary embodiment. For example, more than two cables running adjacent to one another can form the arrangement according to the invention. Instead of the twisted-pair cables, star quad cables with a stranding group formed of four wires can be used. The stranding length X can vary, preferably periodically and/or statistically, over the length of the cable in the longitudinal direction L.

The invention also relates to a raw cable for manufacturing the arrangement according to the invention with at least one marking 70 on an outer side.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An arrangement of at least two separate twisted-pair cables, comprising a first cable and a second cable which extend adjacently in a substantially parallel manner, and of which each having a stranding group consisting of a twisted conductor pair, wherein the lay length (A, A', B, B') of each of the stranding groups varies in the longitudinal direction of the cables, and the lay length (A) of at least one stranding group winding of the stranding group of the first cable differs from the lay length (B) of an adjacent stranding group winding of the stranding group of the second cable by more than 10%, the lay length of the stranding groups varying between a minimum lay length (A) and a maximum lay length (A'), wherein a distance between two adjacent stranding sections of a stranding group with a minimum lay length (A) defines a stranding length (X), wherein the stranding length (X) of a stranding group varies sinusoidally in the longitudinal direction of the cable (L).

2. The arrangement of claim 1, wherein the lay length (A) of at least one stranding group winding of the stranding group of the first cable differs from the lay length (B) of an adjacent stranding group winding of the stranding group of the second cable by more than 50%.

3. The arrangement of claim 1, wherein each stranding group includes a conductor pair for transmission of a differential signal.

4. The arrangement of claim 1 wherein the lay length of the stranding groups in each case varies periodically and/or in a wave-formed manner.

5. The arrangement of claim 4 wherein the lay length of the stranding groups in each case varies periodically sinusoidally.

6. The arrangement of claim 1 wherein the minimum lay length is greater than 5 mm and less than 20 mm.

7. The arrangement of claim 6 wherein the minimum lay length is greater than 10 mm and less than 15 mm.

8. The arrangement of claim 1 wherein the stranding length (X) is greater than 0.5 m and less than 10 m.

9. The arrangement of claim 8 wherein the stranding length (X) is greater than 2 m and less than 5 m.

10. The arrangement of claim 1 wherein the at least two cables are individual cables arranged at a distance from one another.

11. The arrangement of claim 1, wherein each cable carries on its exterior at least one marking which states a lay length, a lay length pattern and/or a position of a maximum or minimum lay length in the interior of the cable, wherein the marking of the first cable is preferably offset from the marking of the second cable in the longitudinal direction of the cable (L).

12. The arrangement of claim 1, wherein at least one cable carries on its exterior markings at intervals corresponding to the respective stranding length (X).

13. The arrangement of claim 1 wherein the maximum lay length is greater than 15 mm and less than 50 mm.

14. The arrangement of claim 13 wherein the maximum lay length is greater than 22 mm and less than 28 mm.

15. A method for manufacturing a cable arrangement comprising:

providing a raw cable with a stranding group consisting of a twisted conductor pair;

varying the twisted-pair lay length (A, A') of the stranding group in the longitudinal direction of the cable between a minimum lay length (A) and a maximum lay length (A');

varying a distance between two adjacent stranding sections of said at least one stranding group with a minimum lay length (A) defining a stranding length (X);

wherein the stranding length (X) of a stranding group varies sinusoidally in the longitudinal direction of the cable (L), cutting the raw cable so that at least one first and one second cable are produced; and arranging the two twisted-pair cables adjacent to one another such that the lay length of a stranding group winding of the first cable differs by more than 10% from the lay length of a stranding group winding of the second cable arranged next to it.

16. The method of claim 15, wherein the step of application of markings to an outer side of the raw cable depending on the pattern of the lay lengths in the interior of the raw cable.

17. The method of claim 16, wherein during the step involving the arrangement step of the two cables, a marking of the first cable is positioned offset to a marking of the second cable.

* * * * *